US009722362B2

(12) United States Patent
Chang

(10) Patent No.: US 9,722,362 B2
(45) Date of Patent: Aug. 1, 2017

(54) ELECTRICAL CONNECTOR WITH IMPROVED SHIELDING SHELL

(71) Applicant: T-CONN PRECISION CORPORATION, New Taipei (TW)

(72) Inventor: Jen-Hao Chang, New Taipei (TW)

(73) Assignee: T-CONN PRECISION CORPORATION, New Taipei (TW)

( * ) Notice: Subject to any disclaimer, the term of this patent is extended or adjusted under 35 U.S.C. 154(b) by 0 days.

(21) Appl. No.: 14/920,920

(22) Filed: Oct. 23, 2015

(65) Prior Publication Data

US 2017/0117671 A1 Apr. 27, 2017

(51) Int. Cl.
*H01R 13/6581* (2011.01)
*H01R 12/72* (2011.01)
*H01R 13/6594* (2011.01)

(52) U.S. Cl.
CPC ..... *H01R 13/6581* (2013.01); *H01R 12/724* (2013.01); *H01R 13/6594* (2013.01)

(58) Field of Classification Search
CPC ..... H01R 13/6594; H01R 12/724; H01R 13/6581
USPC ..... 439/607.01, 607.35, 607.4, 607.55, 660
See application file for complete search history.

(56) References Cited

U.S. PATENT DOCUMENTS

| | | | | |
|---|---|---|---|---|
| 7,753,729 | B2 * | 7/2010 | Wang | H01R 13/41 439/607.01 |
| 9,391,410 | B2 * | 7/2016 | Yu | H01R 13/6594 |
| 2014/0113497 | A1 * | 4/2014 | Wang | H01R 13/52 439/660 |
| 2016/0020560 | A1 * | 1/2016 | Ju | H01R 24/78 439/607.05 |

* cited by examiner

*Primary Examiner* — Abdullah Riyami
*Assistant Examiner* — Justin Kratt
(74) *Attorney, Agent, or Firm* — Bacon & Thomas, PLLC

(57) ABSTRACT

An electrical connector with improved shielding shell includes an insulating body having a base and a tongue plate; a terminal set comprising multiple terminals provided on two surfaces of the tongue plate; a shielding shell joined with the base, comprising an opening portion and a chamber in mutual communication, and furthermore, a top surface and a bottom surface of the shielding shell are provided with corresponding engagement units, respectively, two ends of each engagement unit are connected integrally with the shielding shell, and a buckling portion and a grounding portion extending into the chamber are provided on each engagement unit, respectively; and a rear cover joining the base and the shielding shell. Thereby, the buckling portion and the grounding portion of each engagement unit as well as the docking connector perform engagement and grounding capabilities, two ends of each engagement unit are connected integrally with the shielding shell, such that longer operating duration and better electrical characteristics are accomplished.

7 Claims, 10 Drawing Sheets

ELECTRICAL CONNECTOR WITH IMPROVED SHIELDING SHELL

BACKGROUND OF THE INVENTION

Field of the Invention

The invention is an electrical connector with improved shielding shell, which is particularly related to an electrical connector for insertion with a docking connector, forming engagement and grounding capabilities by each engagement unit, and achieving longer operating duration and better electrical characteristics by means of connection of each engagement unit with the shielding shell.

Descriptions of the Related Art

Conventionally, for example, in U.S. Pat. No. 9,028,269 B2 titled "Electrical connector with improved metal shell" (Kuo-Chun Hsu et al.), a shielding housing is provided with a mating cavity and a top wall surrounding the mating cavity, the top wall is provided with at least one buckling elastic sheet thereon, the buckling elastic sheet includes a connection end in connection with the top wall and a free end disposed opposite to the connection end; wherein the buckling elastic sheet is provided with a buckle protruding into the mating cavity and a grounding portion located inside the buckle, and the depth by which the buckle protruding into the mating cavity is larger than the depth by which the grounding portion protruding into the mating cavity.

From the prior art described above, engagement and grounding actions may be performed by the buckle and the grounding portion of the buckling elastic sheet and the docking connector. However, one end of the buckling elastic sheet is connected with the top wall of the shielding housing, while another end is a free end, which is not in connection with the shielding housing, so that with respect to structural consideration, multiple times of insertion and removal for the docking connector in use is prone to deforming the buckling elastic sheet upwards and downwards to disable buckling and grounding operation of the buckling elastic sheet and the docking connector, or the buckling elastic sheet will damage the internal structure of the docking connector during insertion. Accordingly, not only operating duration of the electrical connector is shortened, but also there is impact on electrical characteristics of the docking connector after insertion.

In view of this, the inventor of the invention have researched and developed an electrical connector with improved shielding shell in order to overcome the above conventional technology with respect to various shortages thereof.

SUMMARY OF THE INVENTION

The major objective of the invention is in that a docking connector may be allowed to enter the chamber through the opening portion and to be inserted with the tongue plate, and be conducted electrically with the terminal set. Moreover, the buckling portion and the grounding portion of each engagement unit as well as the docking connector form engagement and grounding capabilities, and in turn, two ends of each engagement unit are connected integrally with the shielding shell, so that each engagement unit may be less prone to deformation, and further, damage occurred with internal structure of the docking connector may be avoided, such that longer operating duration and good electrical characteristics are accomplished.

To achieve above objective, the invention is an electrical connector with improved shielding shell, including: an insulating body having a base and a tongue plate; a terminal set comprising multiple terminals provided on two surfaces of the tongue plate, the tail end of each terminal extending out of the base; a shielding shell joining with the base, the shielding shell comprising an opening portion and a chamber in communication with the opening portion and accommodating the tongue plate, and a top surface and a bottom surface of the shielding shell being provided with corresponding engagement units thereon, respectively, two ends of each engagement unit being connected with the shielding shell, and each engagement unit being provided with a buckling portion and a grounding portion thereon extending into the chamber, respectively; and a rear cover joining with the base and the shielding shell.

In the embodiment, the top surface of the base is provided with a securing portion thereon, two sides of the securing portion are provided with a groove, respectively, and two sides of the base are provided with a bump, respectively, for the insulating body to join with the shielding shell and the rear cover by the securing portion, the groove and the bump thereof.

In the embodiment, the shielding shell has a notch portion provided across a surrounding rim of the securing portion provided on the base, each of two sides of the notch portion is provided with a first withholding sheet abutting in the groove provided on the base, while each of two sides of the shielding shell is provided with a rabbet abutting with the respective bump, and each of two sides of the shielding shell is provided with a respective retention foot and a respective welding foot extending downwardly, each retention foot is provided with a respective second withholding sheet thereon, and two sides and the top surface of the shielding shell adjacent to the opening portion are provided with a clamping elastic sheet, respectively.

In the embodiment, a top of the rear cover is provided with a first engagement portion abutting with a securing portion provided on the base, and each of two sides of the rear cover is provided with a respective second securing portion abutting with a second withholding sheet provided on a retention foot.

In the embodiment, each of the engagement units comprises a first inclined plate connected with a surface of the shielding shell and extending to the first inclined plate within the chamber, a second inclined plate connected with the surface of the shielding shell and extending into the chamber and in correspondence with the first inclined plate, and a curved plate connected between the first inclined plate and the second inclined plate for a buckling portion to be formed between the first inclined plate and the curved plate, and for a grounding portion to be formed between the second inclined plate and the curved plate.

In the embodiment, each of the engagement units comprises an inclined plate in connection with a surface of the shielding shell and extending into the chamber, a straight plate connecting the surface of the shielding shell and the inclined plate, and a bulge provided on the straight plate and extending into the chamber for a buckling portion to be formed between the inclined plate and the straight plate, and the bulge on the straight plate performed as the grounding portion.

In the embodiment, the grounding portion on the straight plate is a round bulge, a round-dot bulge or an oval bulge.

In the embodiment, each of the engagement units comprises an inclined plate in connection with a surface of the shielding shell and extending into the chamber, a straight plate connecting the surface of the shielding shell and the inclined plate, and an elastic piece provided on one end of the straight plate and extending into the chamber for a buckling portion to be formed between the inclined plate and the straight plate, and the elastic piece extends toward to the rear cover to form a free end.

In the embodiment, each of the engagement units comprises an inclined plate in connection with a surface of the shielding shell and extending into the chamber, a straight plate connecting the surface of the shielding shell and the inclined plate, and an elastic piece provided on one end of the straight plate and extending into the chamber for a buckling portion to be formed between the inclined plate and the straight plate, and the elastic piece extends toward to the opening portion to form a free end.

In the embodiment, each of the engagement units comprises an inclined plate in connection with a surface of the shielding shell and extending into the chamber, a straight plate connecting the surface of the shielding shell and the inclined plate, and an elastic piece provided on one end of the straight plate and extending into the chamber for a buckling portion to be formed between the inclined plate and the straight plate, and each of the elastic pieces of adjacent engagement units can extend toward to the rear cover and the opening portion to form a respective free end.

In another embodiment of the invention, a shielding shell and a rear cover are comprised; the shielding shell comprises an opening portion and a chamber in communication with the opening portion, and a top surface and a bottom surface of the shielding shell are provided with corresponding engagement units thereon, respectively, two ends of each engagement unit are connected with the shielding shell, and each engagement unit is provided with a buckling portion and a grounding portion thereon extending into the chamber, respectively, and the rear cover joins with the shielding shell.

DETAILED DESCRIPTION OF THE PREFERRED EMBODIMENT

Figure 1:
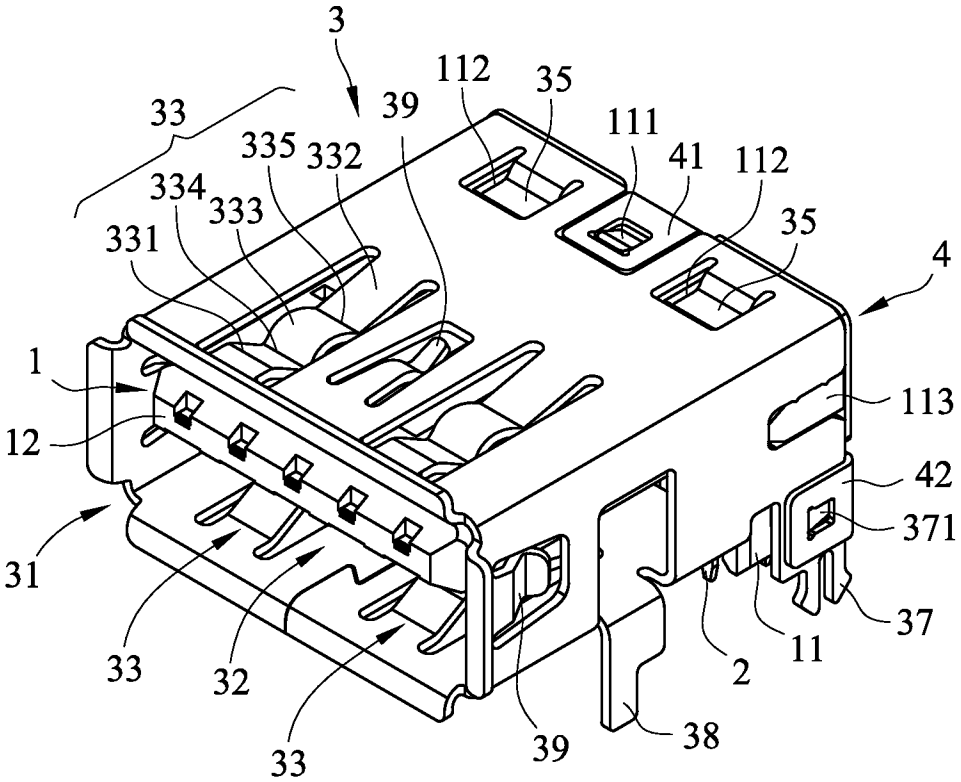
FIG. 1 is a perspective view diagram showing the appearance of a first embodiment of the invention.
Figure 2:
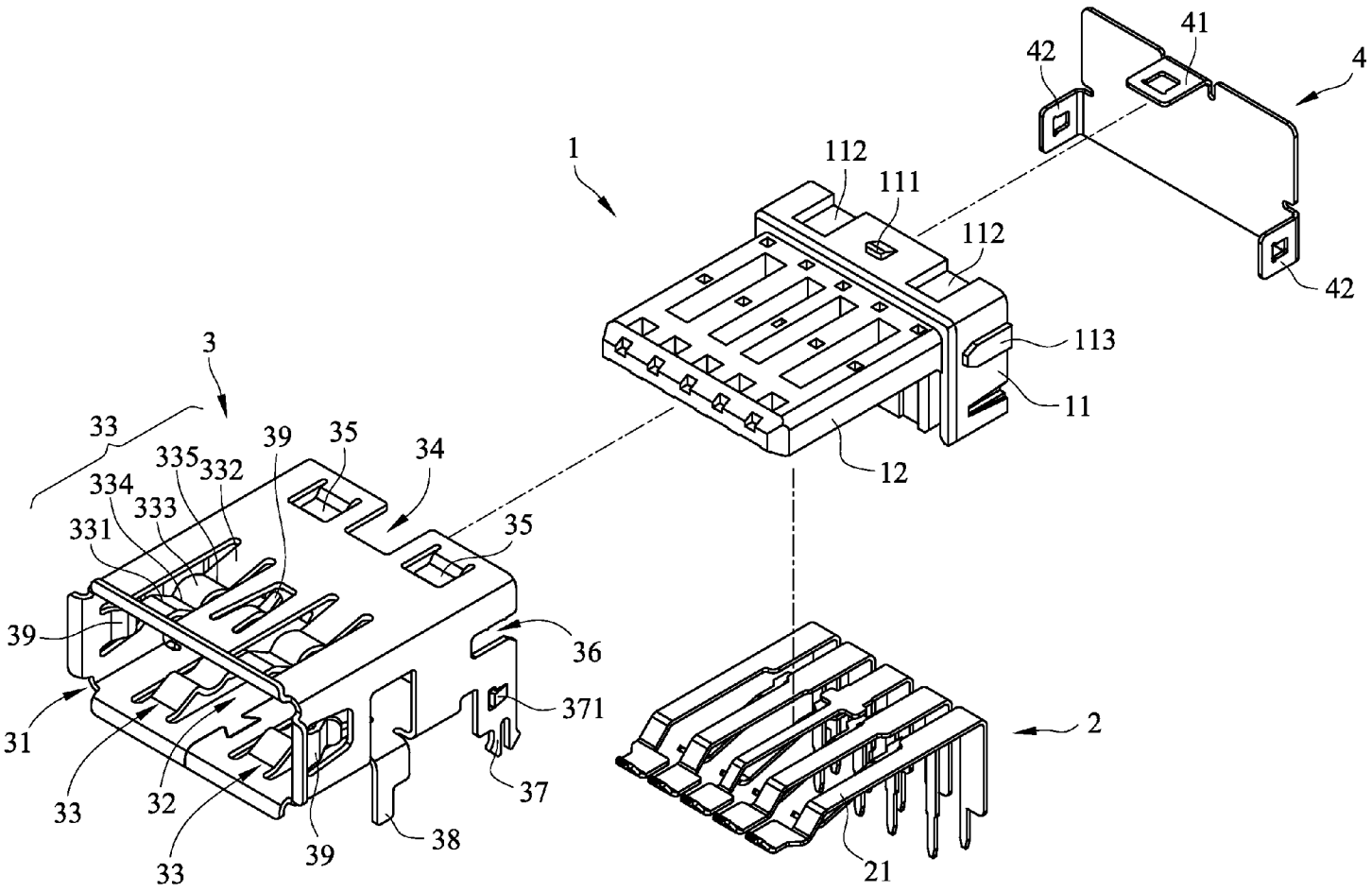
FIG. 2 is an exploded schematic diagram showing elements of the first embodiment of the invention.
Figure 3:
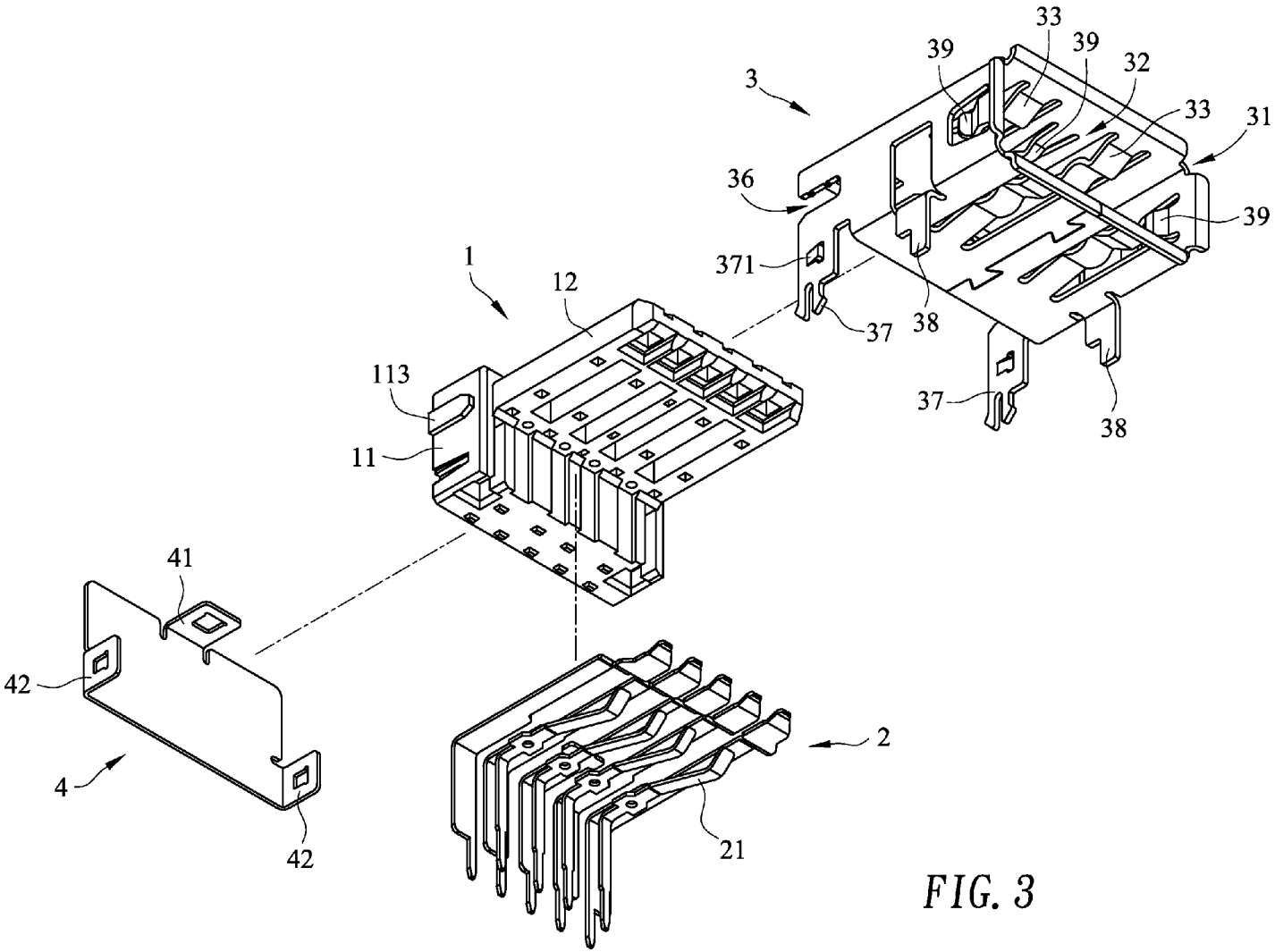
FIG. 3 is another exploded schematic diagram showing elements of the first embodiment of the invention.
Figure 4:
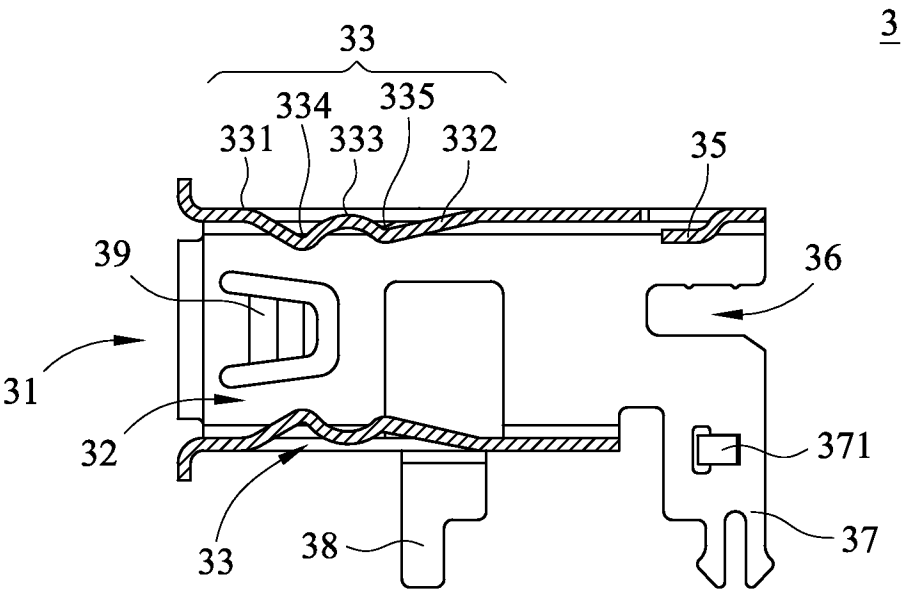
FIG. 4 is a schematic diagram showing a cross section of the first embodiment of the invention.

For thorough understanding of objectives, features and effects of the invention, the invention is described in detail as following in conjunction with attached drawings by means of embodiments.

Refer to FIGS. 1, 2, 3 and 4, which are a perspective view showing appearance of a first embodiment of the invention, an exploded schematic diagram showing elements of the first embodiment of the invention, another exploded schematic diagram showing elements of the first embodiment of the invention, and a schematic diagram showing a cross section of the first embodiment of the invention. As shown in the Figures, the invention is an electrical connector with improved shielding shell, comprising at least an insulating body 1, a terminal set 2, a shielding shell 3 and a rear cover 4.

The above insulating body 1 comprises a base 11, and a tongue plate 12 provided on an end surface of the base 11, wherein a top surface of the base 11 is provided with a securing portion 111 thereon, two sides of the securing portion 111 are provided with a groove 112, respectively, and two sides of the base 11 are provided with a bump 113, respectively.

The terminal set 2 comprises multiple terminals 21 provided on two surfaces of the tongue plate 12, and the tail end of each terminal 21 is extended out of the base 11.

The shielding shell 3 joins with the insulating body 1 and the base 11. The shielding shell 3 comprises an opening portion 31, and a chamber 32 in communication with the opening portion 31 and accommodating the tongue plate 12, and a top surface and a bottom surface of the shielding shell 3 are provided with corresponding engagement units 33 thereon, respectively. Two ends of each engagement unit 33 are connected integrally with the shielding shell 3, and each engagement unit 33 is provided with a buckling portion 334 and a grounding portion 335 thereon extending into the chamber 32. Furthermore, each engagement unit 33 comprises a first inclined plate 331 in connection with a surface of the shielding shell 3 and extending into the chamber 32, a second inclined plate 332, which corresponds to the first inclined plate 331, in connection with the surface of the shielding shell 3 and extending into the chamber 32, and a curved plate 333 connected between the first inclined plate 331 and the second inclined plate 332, for a buckling portion 334 to be formed between the first inclined plate 331 and the curved plate 333, while a grounding portion 335 is formed between the second inclined plate 332 and the curved plate 333. Wherein the shielding shell 3 comprises further a notch portion 34 provided across a surrounding rim of the securing portion 111 provided on the base 11, two sides of the notch portion 34 are provided with a first withholding sheet 35 abutting in the groove 112 provided on the base 11, while two sides of the shielding shell 3 are provided with a rabbet 36 abutting with the bump 113, respectively, and two sides of the shielding shell 3 are provided with a retention foot 37 and a welding foot 38 extending downwards, respectively. Each retention foot 37 is provided with a second withholding sheet 371 thereon, respectively, and two sides and the top surface of the shielding shell 3 adjacent to the opening portion 31 are provided with clamping elastic sheet 39 thereon, respectively.

The rear cover 4 joins with the base 11 of the insulating body 1 and the shielding shell 3, wherein the top of the rear cover 4 is provided with a first engagement portion 41 abutting with the securing portion 111 provided on the base 11, two sides of the rear cover 4 are provided with a second engagement portion 42 abutting with the second withholding sheet 371 provided on the retention foot 37.

As the invention is in use, the retention foot 37 and the welding foot 38 of the shielding shell 3 join with a circuit board of related equipment for insertion of associated docking connector to act as a transmission interface (not shown). As it joins the docking connector in use, it may enters the chamber 32 through the opening portion 31 of the shielding shell 3 and to be inserted with the tongue plate 12, such that the docking connector and the terminal set 2 form electrical conduction. After insertion with the docking connector, the shielding shell 3 is clamped outside a metal shell of the docking connector by each clamping elastic sheet 39, and furthermore, performs engagement and grounding capabilities with the metal shell of the docking connector by the buckling portion 334 and the grounding portion 335 of the engagement unit 33, respectively. In addition, with cooperation of the first inclined plate 331, the second inclined plate 332 and the curved plate 333 of each engagement unit 33, two ends of each engagement unit 33 are connected integrally with the shielding shell 3 in a continual structure, instead of a breaking structure on one end of an elastic sheet of a conventional metal shell, such that the buckling portion 334 and the grounding portion 335 extend into the chamber 32. Therefore, not only each engagement unit 33 is less prone to deformation in use, but also damage occurred with internal structure of the docking connector may be avoided, such that longer operating duration and better electrical characteristics are accomplished.

Figure 5:
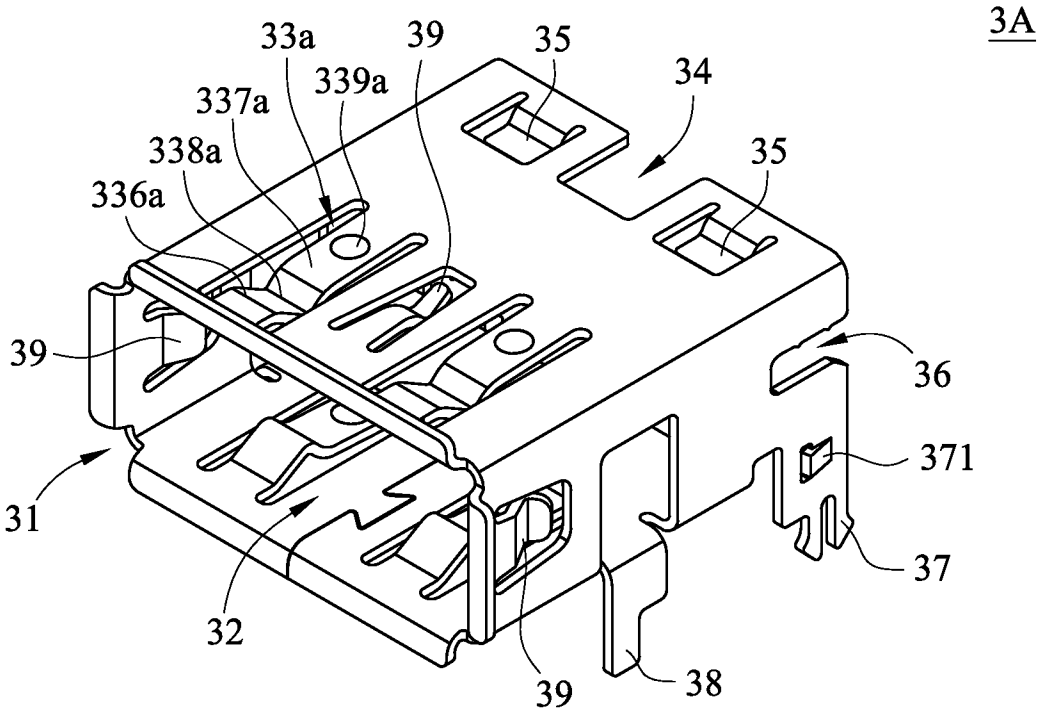
FIG. 5 is a perspective view showing appearance of a second embodiment of the invention.
Figure 6:
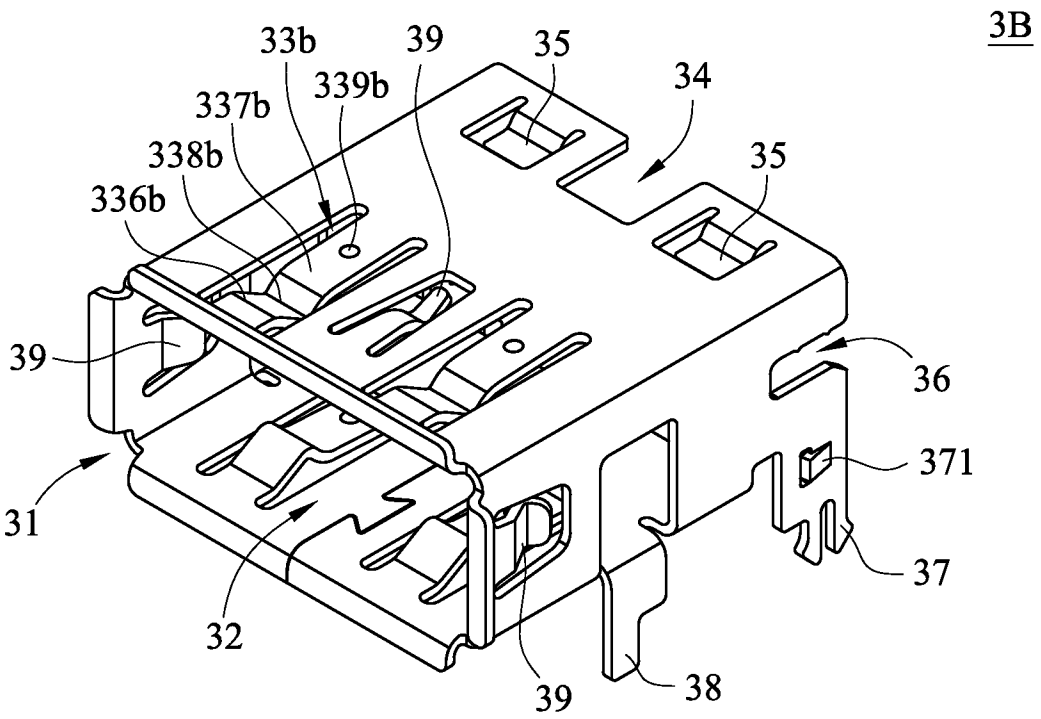
FIG. 6 is a perspective view showing appearance of a third embodiment of the invention.
Figure 7:
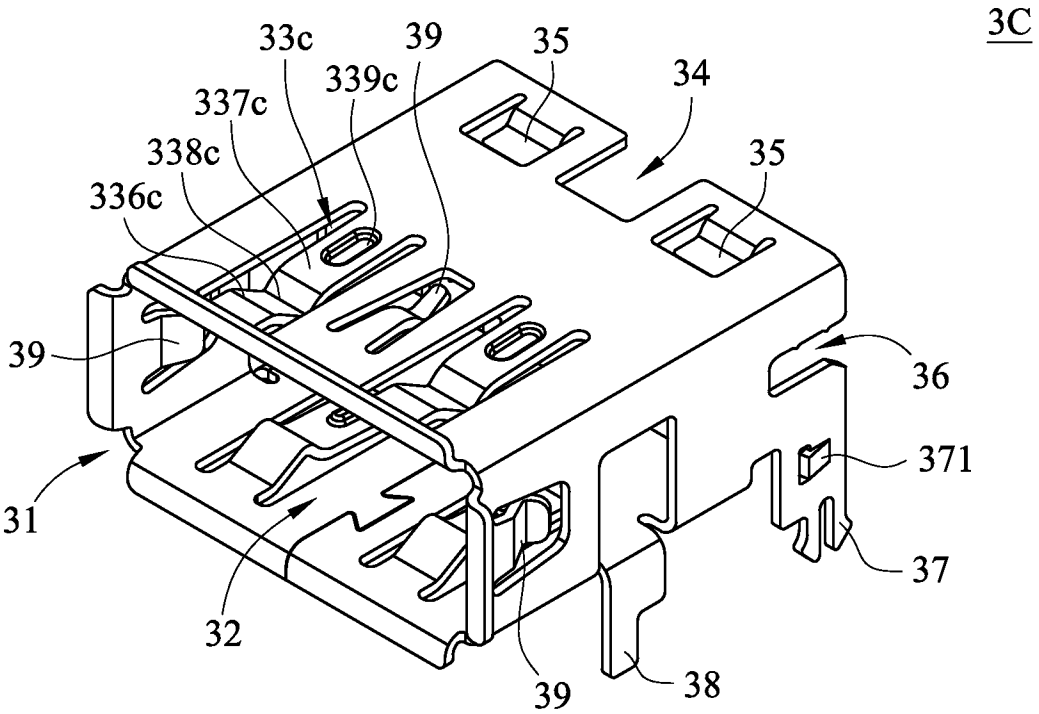
FIG. 7 is a perspective view showing appearance of a fourth embodiment of the invention.

Refer to FIGS. 5, 6 and 7, which are a perspective view showing appearance of a second embodiment of the invention, a perspective view showing appearance of a third embodiment of the invention, and a perspective view showing appearance of a fourth embodiment of the invention. As shown in the Figures, in addition to be of the structure illustrated in the first embodiment above, the invention may also be of the other structure of the second, third and fourth embodiment with difference in that each engagement unit 33*a*, 33*b*, 33*c* comprises an inclined plate 336*a*, 336*b*, 336*c* in connection with a surface of each shielding shell 3A, 3B, 3C and extending into the chamber 32, a straight plate 337*a*, 337*b*, 337*c* connecting the surface of the shielding shell 3 and the inclined plate 336*a*, 336*b*, 336*c*, and a bulge (339*a*, 339*b*, 339*c*) provided on the straight plate 337*a*, 337*b*, 337*c* and extending into the chamber 32, for a buckling portion 338*a*, 338*b*, 338*c* to be formed between the inclined plate 336*a*, 336*b*, 336*c* and the straight plate 337*a*, 337*b*, 337*c*, and for the bulge on the straight plate 337*a*, 337*b*, 337*c* to perform as a grounding portion 339*a*, 339*b*, 339*c*, wherein the grounding portion 339*a*, 339*b*, 339*c* on the straight plate 337*a*, 337*b*, 337*c* is a round bulge, a round-dot bulge or an oval bulge. As such, the buckling portion 338*a*, 338*b*, 338*c* and the grounding portion 339*a*, 339*b*, 339*c* may also be utilized to perform engagement and grounding capabilities with the metal shell of the docking connector, so that not only the effect described in the first embodiment is achieved, but also compliance to practical use is met.

Figure 8:
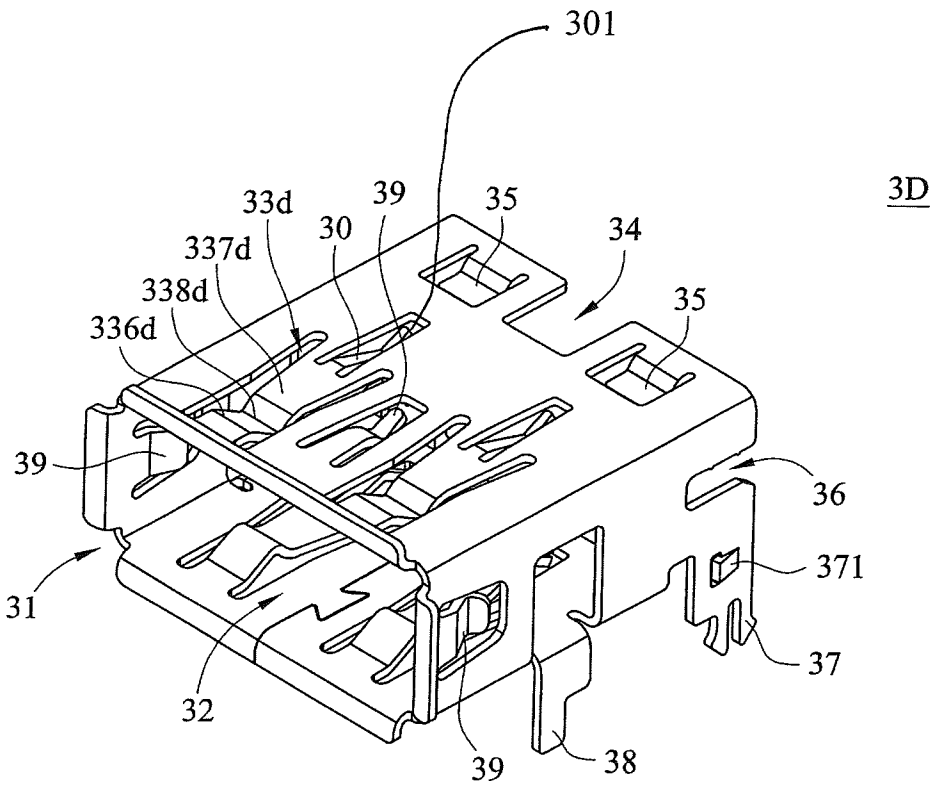
FIG. 8 is a perspective view showing appearance of a fifth embodiment of the invention.
Figure 9:
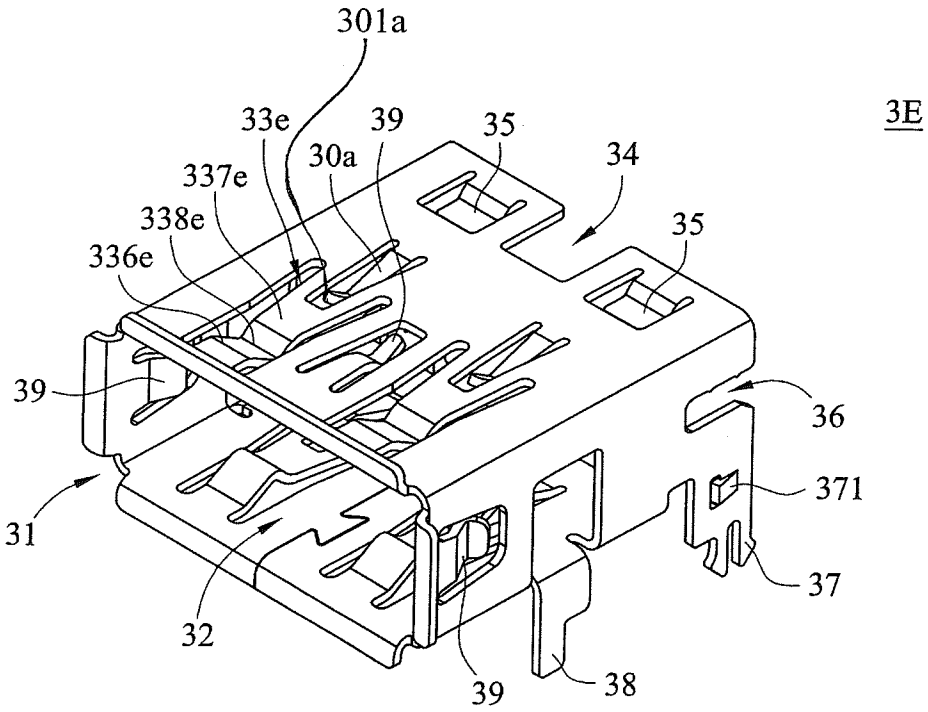
FIG. 9 is a perspective view showing appearance of a sixth embodiment of the invention.
Figure 10:
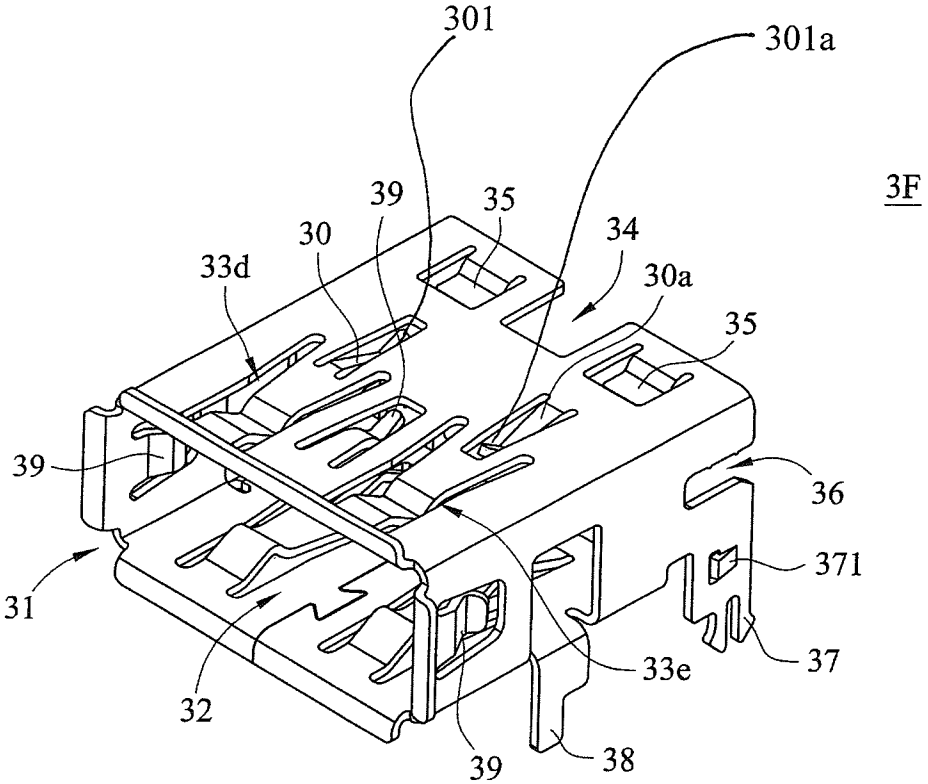
FIG. 10 is a perspective view showing appearance of a seventh embodiment of the invention.

Refer to FIGS. 8, 9 and 10, which are a perspective view showing appearance of the fifth embodiment of the invention, a perspective view showing appearance of the sixth embodiment of the invention, and a perspective view showing appearance of the seventh embodiment of the invention. As shown in the Figures, in addition to of the structures illustrated in the first to fourth embodiments, the invention may also be of the structures of the fifth, sixth and seventh embodiments with difference in that each engagement unit 33*d*, 33*e* comprises an inclined plate 336*d*, 336*e* in connection with a surface of each shielding shell 3D, 3E and extending into the chamber 32, a straight plate 337*d*, 337*e* connecting the surface of the shielding shell 3D, 3E and the inclined plate 336*d*, 336*e*, and an elastic piece 30, 30*a* provided on one end of the straight plate 337*d*, 337*e* and extending into the chamber 32, for a buckling portion 338*d*, 338*e* to be formed between the inclined plate 336*d*, 336*e* and the straight plate 337*d*, 337*e*, and for the elastic piece 30, 30*a* on the straight plate 337*d*, 337*e* to perform as a grounding portion, and for the elastic piece 30, 30*a* to extend toward to the rear cover 4 or the opening portion 31 to form a free end 301,301*a*. In addition, the two forms of engagement units 33*d*, 33*e* described above may also be disposed on the shielding shell 3F in an adjacent manner, and the elastic piece 30, 30*a* of each adjacent engagement unit 33*d*, 33*e* extends toward to the rear cover 4 and the opening portion 31 to form a free end 301,301*a*. However, only the elastic piece 30, 30*a* has a free end 301,301*a* for the engagement unit 33*d*, 33*e* described above, the inclined plate 336*d*, 336*e* and the straight plate 337*d*, 337*e* is still in connection with the surface of the shielding shell 3F. Thereby, the buckling portion 338*d*, 338*e* and the elastic piece 30, 30*a* (i.e., grounding portion) may also be utilized to perform engagement and grounding capabilities with the metal shell of the docking connector, so that not only the effect described in the first embodiment is achieved, but also compliance to practical use is met.

In summary, with the disclosure above, the invention can achieve actually the expected objectives of the invention, such that a docking connector may be allowed to enter the chamber through the opening portion of the electrical connector of the invention and to be inserted with the tongue plate, and be conducted electrically with the terminal set. Moreover, the buckling portion and the grounding portion of each engagement unit as well as the docking connector perform engagement and grounding capabilities, and in turn, two ends of each engagement unit are connected integrally with the shielding shell, so that each engagement unit may be less prone to deformation, and further, damage occurred with internal structure of the docking connector may be avoided, such that longer operating duration and better electrical characteristics are accomplished.

The description above are only preferred embodiments of the invention, any equivalent modification made within the scope of claims of the invention shall be within the substantial scope of the invention.

What is claimed is:

1. An electrical connector with an improved shielding shell, including:

an insulating body comprising a base, and a tongue plate provided on an end surface of the base;

a terminal set comprising multiple terminals provided on two surfaces of a tongue plate, a tail end of each of the terminals being extended out of the base;

a shielding shell joined with the base of the insulating body, the shielding shell comprising an opening portion and a chamber in communication with the opening portion and accommodating the tongue plate, a top surface and a bottom surface of the shielding shell being provided with corresponding engagement units thereon, respectively, two ends for each of the engagement units being connected integrally with the shielding shell, and each of the engagement units being provided with a buckling portion and a grounding portion extending into the chamber, respectively, each of the engagement units comprises an inclined plate in connection with a surface of the shielding shell and extending into the chamber, a straight plate connecting the surface of the shielding shell and the inclined plate, and a bulge provided on the straight plate and extending into the chamber for a buckling portion to be formed between the inclined plate and the straight plate, and the bulge on the straight plate performs as the grounding portion, the shielding shell has a notch portion provided across a surrounding rim of the securing portion provided on the base, each of two sides of the notch portion is provided with a first withholding sheet abutting in the groove provided on the base, while each of two sides of the shielding shell is provided with a rabbet abutting with the respective bump, each of two sides of the shielding shell is provided with a respective retention foot and a respective welding foot extending downwardly, each retention foot is provided with a respective second withholding sheet thereon, and two sides and the top surface of the shielding shell adjacent to the opening portion are provided with clamping elastic sheets, respectively; and a rear cover joining with the base of the insulating body and the shielding shell, a top of the rear cover is provided with a first engagement portion abutting with a securing portion provided on the base, and each of two sides of the rear cover is provided with a respective second securing portion abutting with a second withholding sheet provided on a retention foot.

2. The electrical connector with an improved shielding shell as described in claim 1, wherein the grounding portion on the straight plate is a round bulge, a round-dot bulge or an oval bulge.

3. The electrical connector with an improved shielding shell as described in claim 1, wherein each of the engagement units comprises an inclined plate in connection with a surface of the shielding shell and extending into the chamber, a straight plate connecting the surface of the shielding shell and the inclined plate, and an elastic piece provided on one end of the straight plate and extending into the chamber for a buckling portion to be formed between the inclined plate and the straight plate, and the elastic piece extends toward the rear cover to form a free end.

4. The electrical connector with an improved shielding shell as described in claim 1, wherein each of the engagement units comprises an inclined plate in connection with a surface of the shielding shell and extending into the chamber, a straight plate connecting the surface of the shielding shell and the inclined plate, and an elastic piece provided on one end of the straight plate and extending into the chamber for a buckling portion to be formed between the inclined plate and the straight plate, and the elastic piece extends toward the opening portion to form a free end.

5. The electrical connector with an improved shielding shell as described in claim 1, wherein each of the engagement units comprises an inclined plate in connection with a surface of the shielding shell and extending into the chamber, a straight plate connecting the surface of the shielding shell and the inclined plate, and an elastic piece provided on one end of the straight plate and extending into the chamber for a buckling portion to be formed between the inclined plate and the straight plate, and each of the elastic pieces of adjacent engagement units can extend toward either of the rear cover and the opening portion to form a respective free end.

6. An electrical connector with an improved shielding shell, including:

an insulating body comprising a base, and a tongue plate provided on an end surface of the base;

a terminal set comprising multiple terminals provided on two surfaces of a tongue plate, a tail end of each of the terminals being extended out of the base;

a shielding shell joined with the base of the insulating body, the shielding shell comprising an opening portion and a chamber in communication with the opening portion and accommodating the tongue plate, a top surface and a bottom surface of the shielding shell being provided with corresponding engagement units thereon, respectively, two ends for each of the engagement units being connected integrally with the shielding shell, and each of the engagement units being provided with a buckling portion and a grounding portion extending into the chamber, respectively, each of the engagement units comprises an inclined plate in connection with a surface of the shielding shell and extending into the chamber, a straight plate connecting the surface of the shielding shell and the inclined plate, and an elastic piece provided on one end of the straight plate and extending into the chamber for a buckling portion to be formed between the inclined plate and the straight plate, the shielding shell has a notch portion provided across a surrounding rim of the securing portion provided on the base, each of two sides of the notch portion is provided with a first withholding sheet abutting in the groove provided on the base, while each of two sides of the shielding shell is provided with a rabbet abutting with the respective bump, each of two sides of the shielding shell is provided with a respective retention foot and a respective welding foot extending downwardly, each retention foot is provided with a respective second withholding sheet thereon, and two sides and the top surface of the shielding shell adjacent to the opening portion are provided with clamping elastic sheets, respectively; and a rear cover joining with the base of the insulating body and the shielding shell;

wherein the top of the rear cover is provided with a first engagement portion abutting with a securing portion provided on the base, and each of two sides of the rear cover is provided with a respective second securing portion abutting with a second withholding sheet provided on a retention foot.

7. The electrical connector with improved shielding shell as described in claim 6, wherein both the elastic pieces extend toward the rear cover to form a free end, or both the elastic pieces extend toward the opening portion to form a free end, or one of the elastic piece of adjacent engagement units can extend toward the rear cover and the other elastic piece can extend toward the opening portion to form a respective free end.

* * * * *